US006183373B1

(12) United States Patent
Falvo

(10) Patent No.: US 6,183,373 B1
(45) Date of Patent: Feb. 6, 2001

(54) RITE SPEED PUTTING ACCESSORY

(76) Inventor: Anthony F. Falvo, 205 W. End Ave., Long Branch, NJ (US) 07740

( * ) Notice: Under 35 U.S.C. 154(b), the term of this patent shall be extended for 0 days.

(21) Appl. No.: 09/366,112

(22) Filed: Aug. 2, 1999

Related U.S. Application Data

(63) Continuation-in-part of application No. 08/954,109, filed on Oct. 20, 1997, now abandoned.

(51) Int. Cl.[7] ..... A63B 69/36
(52) U.S. Cl. ..... 473/180; 473/186
(58) Field of Search ..... 473/180, 186, 473/174, 181, 182, 185, 190; 463/47.5; 482/82

(56) References Cited

U.S. PATENT DOCUMENTS 4,007,931 * 2/1977 Wich et al. ..... 463/47.5

* cited by examiner

*Primary Examiner*—Mark S. Graham
(74) *Attorney, Agent, or Firm*—Clifford G. Frayne

(57) ABSTRACT

A golf putting practice accessory having two adjustable markers for defining and simulating a conventional golf hole and for permitting a golf ball to pass therethrough, there being attached to these markers, a flexible member for defining a circumscribed area with said two markers whereby a golf ball stopping within the circumscribed area and not exiting the circumscribed area is indicative of a putting stroke made with optimum force.

6 Claims, 2 Drawing Sheets

RITE SPEED PUTTING ACCESSORY

This application is a continuation-in-part of Ser. No. 08/954,109 filed Oct. 20, 1997, abandoned.

BACKGROUND OF THE INVENTION

1. Field of the Invention

This invention relates to golf putting targets which enables golfers to improve their putting game. Specifically, where a visually representative practice hole is needed that allows the golfer to practice from any distance with direct visual feedback that the line was correct and the force of the stroke and hence the speed of the ball was optimum.

2. Description of the Prior Art

Putting is a test of skill requiring regular, high-quality practice. Suitable surfaces, both indoors and outdoors, can be used for putting. In many instances, a carpeted surface indoors, such as that found in professional offices or one's family room in a home, must suffice for practice putting. Inclement weather, time and/or convenience make an indoor location practical. In such circumstances, the golfer has a need for a visually representative putting target that provides feedback on both the line and speed of the practice stroke similar to an actual golf hole. A practice set up is required which does not impede the natural movements of the golf ball. The practice set up should be a close simulation to the actual exterior putting environment.

Various methods of practice putting at a hole have been known in the previous art: Certain of these involve the placement of ball receivers of metal, ceramic, and the like, and directing a golf ball by means of a putter at the receiver. Other more sophisticated forms involve the use of an electrical device which can return a ball putted at the same. One of the problems involved in the use of these and other devices of said type is that the devices do not actually present a hole or in the green on the golf course. These devices are hard to carry as one travels. Many of these devices that do come close to simulating the hole are expensive to make and purchase.

Examples of several relevant types as described below.

McCaul, U.S. Pat. No. 3,048,405 describes a golf target which provides a specific point of aim and a device which has the counterpart of a flag-carrying pin so that the characteristic addible "click" will result when the putted ball strikes the same. However, this device lacks a realistic method of feedback to inform the player if the all was putted at the optimum speed.

Peabody, U.S. Pat. No. 4,936,583 is of interest since the target depicts actual photographs of a golf hole. This approach has the disadvantage of only accommodating just two predetermined putting distances out of an infinite number; but more importantly providing no feedback if the speed of the ball was optimum as it rolled over the top of the hole. The described art is not suitable for a chipping target because it uses predetermined, short distances.

Garnes, U.S. Pat. No. 5,013,042 simulates a golf hole. The putting is performed with the object of causing a collision between two golf balls which fails to provide the player feedback on the distance the ball would have rolled past the hole.

Kehoe, U.S. Pat. No. 5,435,560 teaches of a target simulating a real golf hole comprised of a flat circular disk for practice putting and chipping which through the use of a long strip of adhering material indicates to the golfer if the putted or chipped ball has stopped within 430 mm (17") of the back of the simulated hole; thus providing an indication that the chip or putt was at the optimum speed to be captured by the actual hole. This teaching requires the set up perpendicular to the stroke line a long strip of adhering material behind and perpendicular to the circular target to provide the visual feedback of optimum ball speed. In fact, for the target to work properly, the golfer is required to have a flat adhering strip to mark off the 430 mm (17") each time the target is set up. A separate measurement would certainly have to be made at the start of the putting session and repeatedly thereafter depending on the movement of the circular disk. Such a practice putting system adds complexity to the target; provides increase in time to install and after the practice session to disassembly, creates the probability of loss of components; and increases overall costs of the target. Kehoe provides no method for insuring the circular disk does not move from its established position as the ball traverses said disk during the putting practice.

Other devices such as Brill U.S. Pat. No. 5,060,952; Miner U.S. Pat. No. 4,861,033; Faten U.S. Pat. No. 3,659,856; and others use various elements such as rails, boards, ramps, mechanical devices to capture or guide the ball. In general these patents do not allow the ball to roll unimpeded to, over and past the hole. The main drawback of mechanical devices that capture the ball is that the golfer does not know if the putt or chip was at the optimum speed to be captured by the actual hole. Such feedback is necessary to learning to stroke the ball with the force generating the correct speed that would cause the ball to stop within 430 mm (17") of the back of the hole.

In summary, many inventors have created putting targets or training devices which have been tended to be (mechanically, electrically, or otherwise) complicated; expensive to manufacturers; contained means to capture and return the golf ball; or lacked the necessary feedback to inform the golfer that the ball was optimally stroked, that is not only on line but just as importantly at the correct speed to have the greatest chance of being captured by the hole.

Accordingly, there is a need for a putting target accessory which comprises the target and attached thereto an immediate visual feedback system, which provides feedback as to the line of the stroke and the force of the stroke and hence the speed of the ball, wherein the accessory, as a unit, is compact, minimal in cost, easily set up, is not displaced by the repetitive putting by the ball, and inexpensively stored.

SUMMARY OF THE INVENTION

The accessory comprises a target for the ball comprising a set of markers positioned to simulate the width of a golf hole, and a flexible member in the form of a chain attached to the ends of the two markers of the target circumscribing an area beyond the hole for immediate visual feedback of proper speed and hence force of stroke if the golf ball comes to rest within the circumscribed area. The present invention is a putting accessory or target whose primary emphasis is to allow a golfer to practice and develop his/her a putting stroke of the ball and to impact the ball with the optimum force generating the optimum speed to be captured by the actual hole as represented by the ball which stops within the chain's perimeter of the back of the target hole.

OBJECTS OF THE INVENTION

Our object of this invention is to provide a putting target that is visually representative for distances and allows putting practice in the same geometric plane.

Another object of the present invention is to provide a target that can be easily set-up, adjusted in size and orientation before being fixed in position while being easy for the golfer to pick it up and relocate during practice.

Yet, another object is to provide a putting target that indicates visually to the golfer if the force impacted to the ball in practice is directed to a simulated hole was optimum to have been captured by an actual hole.

Another object is to provide a target which provides visual aiming for practicing short putts.

Finally, another object of the present invention is to provide a device that is easily manufactured at low cost having no mechanical or electrical components and hence being easily transported by a golfer.

DETAILED DESCRIPTION OF THE DRAWINGS

Figure 1:
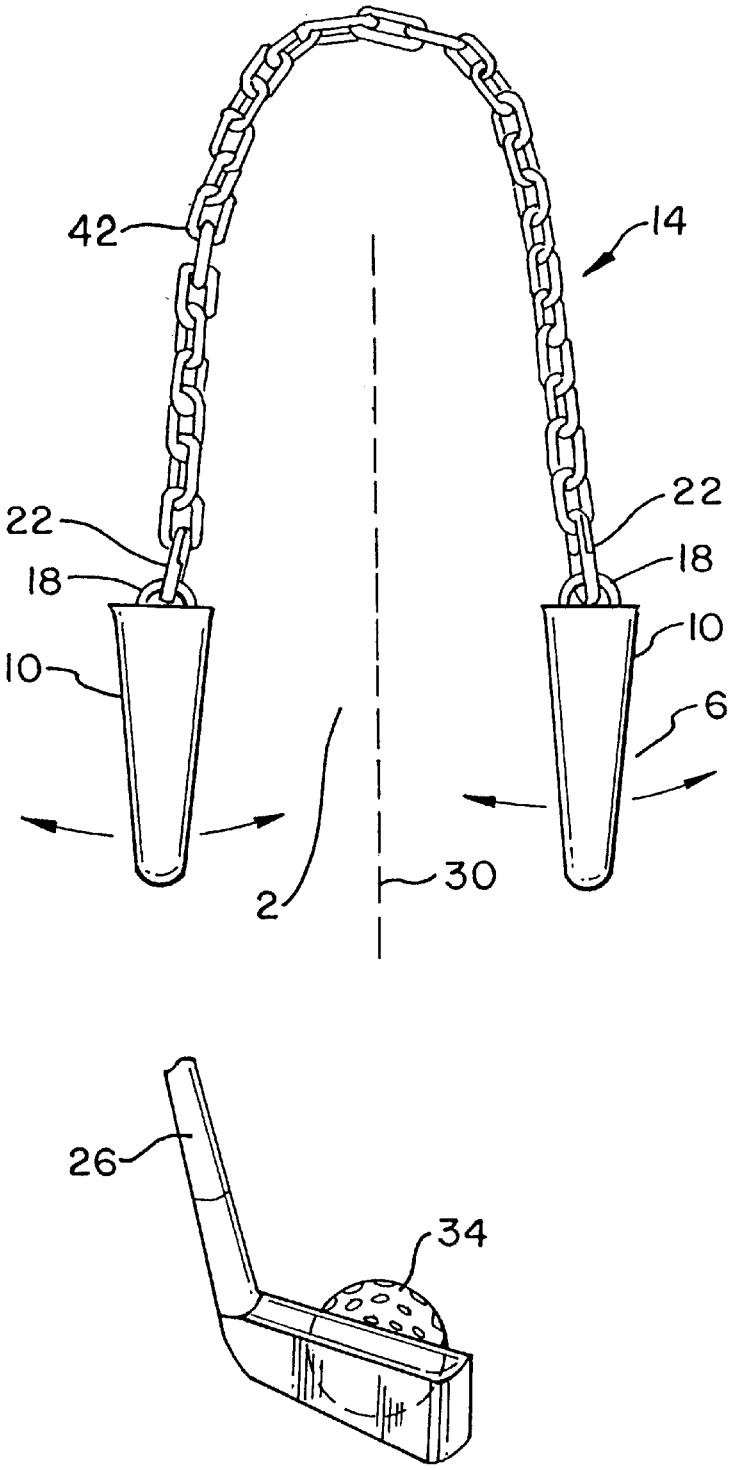
FIG. 1 is a top vie of the entire set up including a golf club, a golf ball and the putting target comprised of two oblong markers in accordance with the preferred embodiment.
Figure 2:
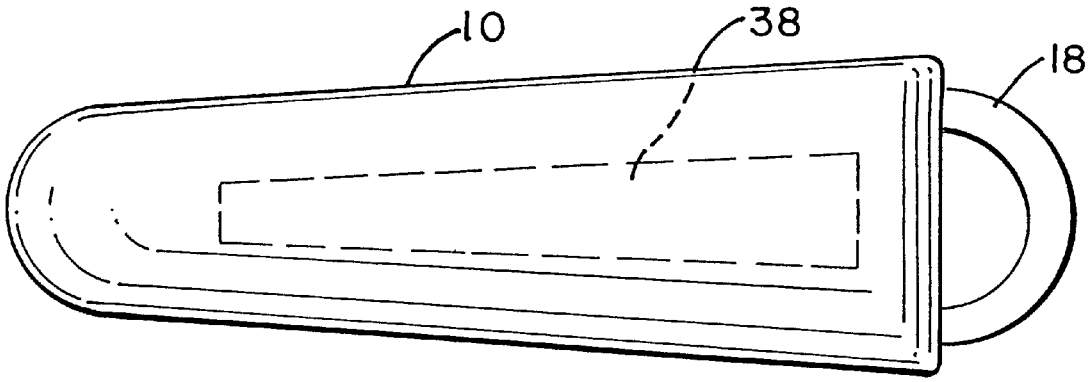
FIG. 2 depicts a close-up top view of the putting target without the speed feedback chain.

FIG. 1 illustrates a top view perspective of a typical set up for a putting practice session. The golfer first adjusts the target 6 width comprised of the two tapered shaped markers 10, simulating the actual golf hole to approximately 108 mm ((4¼") in width. The markers 10 are held firmly to the playing surface plane by a strip of velcro 38 provided with the target 6 and attached to the underside of each marker 10 by the player. At FIG. 2 is shown the velcro 38 which precludes the target 6 set up from being disturbed by the impact of a putting ball which misses the simulated golf hole 2 aperture formed by the two markers 10. The golfer aligns the golf club 26 with a golf ball 34 and the target 6 along the intended stroke line 30. After the golfer makes a stroke he or she then checks to see if the golf ball 34 has rolled through or between the two markers 10 comprising the target 6 and then rested before going over the chain 14 which represents optimum stroke force. All successful strokes from putting (and even chipping) will have passed through the two markers 10 comprising the target 6 and stopped before going beyond or over the chain 14. If the ball jumps the chain 14, the stroke was excessive and a high probability exists that the ball would not have been placed in the actual hole.

FIG. 2 depicts one of the two markers 10 which comprises the target 6 with velcro 38 adhesive to preclude lateral movement of the marker 10 and, hence, the overall target 6. This target 6 is comprised of two substantially oblong, tapered markers 10 which can be made from any number of plastic, vinyl, rubber, metal, wood or other similar materials. The colors for the target vary. At the ends of each marker 10 of the target 6, is a loop 18 which will accept a clip 22 as shown at FIG. 1 which allows for the chain 14 to be attached to each marker 10 comprising the target 6. the marker 10 is approximately six (6) inches in overall length and approximately 1½ inches wide at its maximum width near the loop 18, tapering down to ¼ inch to ½ inch at the opposite end.

Figure 3:
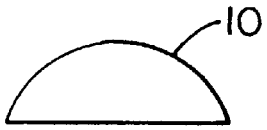
FIG. 3 is a front view of the target.
Figure 4:
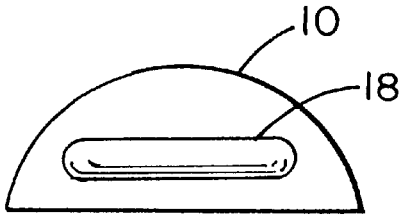
FIG. 4 is a back view of the target without the speed feedback chain.

FIG. 3 and FIG. 4 depict front and back views of the markers 10 which comprise the target 6.

Figure 5:
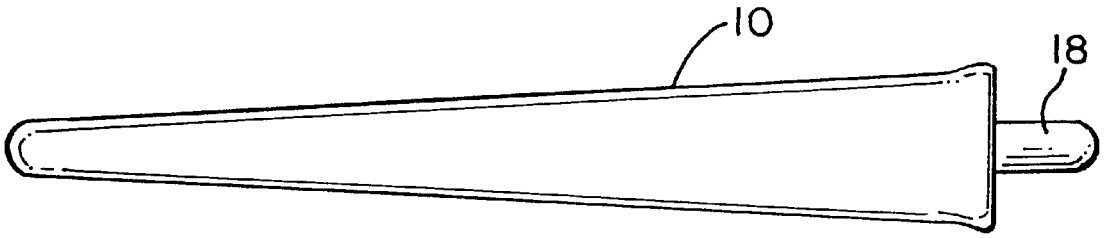
FIG. 5 is a side elevation view of the putting target.

FIG. 5 is a side view of the target 6 marker 10. Each marker 10 which comprises the target 6 varies in vertical height approximately from ¾ inches near the loop 18 to ⅜ inches at the tapered end. The two markers 10 comprising the target 6 visually enhance the simulated golf hole 2 due to their shape and solid contrasting color (e.g. red) vis-a-vis the chain (e.g. white, yellow or other bright color). The target 6 with its two markers 10 serve as a special visual aiming point for the purposes of training the eye to look at the back of the hole when practicing. The connected chain 14 provides the direct visual feedback to the golfer on the success of the player's stroke versus the optimum speed that the stroke should have had. The chain, including its clips 22, can be in the range of from 12 inches to 32 inches so that when connected to the target 6 by the two hinges 18 via the attached clips 22, the distance from the rear of the simulated hole 2 is between approximately 6 inches and 16 inches. The chain links 42 are in the range of between 1 to 2 inches in length between ½ to 1¾ inch in width, so as to permit a ball struck with excessive force to pass over or jump the chain.

In operation, the golfer places the putting target 6 horizontally on the level surface indoor. At that time he/she adjusts the angle of the target 6 and the separation of the target's 6 two markers 10, hence expanding or contracting the simulated golf hole 2, depending on whether the golfer is a beginner focusing on stroke or an experienced player. The intended stroke line 30 can be set at any angle by the very placement of the two markers 10 of the target 6. The target 6 is positioned and firmly set by the attached velcro 38 on the level practice indoor surface. The chain 14 is pre-attached to the two markers 10 of the target 6. The length of the chain 14 and the size of the links 42 in the chain 14 can be varied as a function of the chain's perimeter, however, it has been found in the preferred embodiment that the chain's 14 links 42 in the preferred embodiment are 1½ inches in length and ¾" in width and the chain is 22 inches in length. The chain 14 may be made of metal or plastic and painted a variety of colors to visually discriminate between the target 6 vis-a-vis its visual feedback role.

A ball 34 which passes through the target 6 forming the simulated golf hole 2 and remains inside the area circumscribed by the perimeter of the chain 14 has a good probability of being placed in an actual hole. The ball 34 that crosses over to the chain 14 does not. The golfer has an instant feedback as to his stroke.

Although the present invention has been described in considerable detail with reference to certain preferred versions, many other versions should be apparent to those skilled in the art. Therefore, the spirit and scope of the appended claims should not be limited to the description of the preferred versions contained therein.

Thus there has been shown and described a novel golf putt practice target which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

What is claimed is:

1. A golf putting practice accessory comprising:

an adjustable target comprising two markers defining an opening simulating a conventional golf hole permitting a ball to pass therethrough, wherein said two markers comprises built-in loops at end thereof, said two markers being oblong in shape and constructed of plastic, vinyl, rubber, wood or metal, of approximately six inches in length with width of one and a half inches near said loop ends and tapering down to between one quarter and one half inch; and means for providing immediate visual feedback to a golfer for determining whether a putting stroke on a ball is made at optimum force, said means for providing immediate visual feedback to said golfer comprising a flexible member of a length of between 12 inches and 32 inches attached to said markers and defining a circumscribed area with said two markers whereby a ball stopping within said circumscribed area and not exiting said circumscribed area indicates that a putting stroke is made at optimum force.

2. The golf putting practice accessory of claim 1 wherein said flexible member comprising said means for providing immediate visual feedback to a golfer as to whether a putting stroke on a ball was made at optimum force comprises a chain of multiple chain links defining said circumscribed area where by when a ball stops within said circumscribed area and before crossing said chain, a golfer knows that a putting stroke was made with optimum force.

3. The golf putting practice accessory of claim 1 wherein said two markers for providing said adjustable target simulating a conventional golf hole are fixed in position to a practice surface by means of hook and loop fasteners attached to the bottom of each said marker.

4. The golf putting practice accessory of claim 2 wherein said chain for providing visual feedback to a golfer as to whether or not a putting stroke on a ball was made with optimum force is constructed of metal or plastic with each chain link between 1 and 2 inches in length and between ½ and 1¾ inches in width.

5. The golf putting practice accessory of claim 4 wherein said chain is 22 inches long and comprised of chain links of 1½ inches in length and ¾ inches in width.

6. The golf putting practice accessory of claim 2 in which said chain has clips at its two extremities which attach to said loops of said markers.

* * * * *